US007503714B2

(12) United States Patent
Yamamoto et al.

(10) Patent No.: US 7,503,714 B2
(45) Date of Patent: Mar. 17, 2009

(54) TAPE PRINTER HAVING PLATEN ROLLER AND PRINT HEAD CAPABLE OF BEING FORCIBLY SEPARATED

(75) Inventors: Minoru Yamamoto, Nagoya (JP); Takashi Higashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 339 days.

(21) Appl. No.: 11/347,634

(22) Filed: Feb. 6, 2006

(65) Prior Publication Data

US 2006/0198680 A1 Sep. 7, 2006

(30) Foreign Application Priority Data

Mar. 1, 2005 (JP) ..... 2005-055352

(51) Int. Cl.
*B41J 11/20* (2006.01)

(52) U.S. Cl. ..... 400/692; 400/693; 400/649

(58) Field of Classification Search ..... 400/691, 400/692, 693, 693.1, 649
See application file for complete search history.

(56) References Cited

U.S. PATENT DOCUMENTS 5,120,147 A * 6/1992 Ozaki ..... 400/649
5,295,753 A 3/1994 Godo et al.
5,536,092 A 7/1996 Yamaguchi
5,599,113 A 2/1997 Suzuki et al.
5,839,840 A 11/1998 Kawano
6,132,120 A * 10/2000 Yamaguchi et al. ..... 400/615.2

FOREIGN PATENT DOCUMENTS

EP 0 641 663 A2 3/1995
EP 0 894 640 A2 2/1999
JP A 04-166373 6/1992
JP 07290802 A * 11/1995
JP B2 2546432 8/1996
JP A 10-100494 4/1998

* cited by examiner

*Primary Examiner*—Leslie J Evanisko
(74) *Attorney, Agent, or Firm*—Oliff & Berridge, PLC

(57) ABSTRACT

It is intended to provide a tape printer which enables to forcibly separate a platen roller and a print head along with an opening movement of a cover element in case the platen roller and the print head have adhered to each other because of a long-period storage of the tape printer with the platen roller and the print head being in contact. Accordingly, a cam pressing member and a cam receiver move a roller holder to a withdrawing position in which the platen roller and a thermal head are separated from each other when the cover element is opened, so that the cam pressing member and the cam receiver can be forcibly returned to the withdrawing position from a position in which the platen roller is in contact with the thermal head.

15 Claims, 12 Drawing Sheets

TAPE PRINTER HAVING PLATEN ROLLER AND PRINT HEAD CAPABLE OF BEING FORCIBLY SEPARATED

TECHNICAL FIELD

The disclosure relates to a tape printer, especially to the tape printer which enables to forcibly separate a platen roller and a print head along with an opening movement of a cover element in case the platen roller and the print head have adhered to each other because of a long-period storage of the tape printer with the platen roller and the print head being in contact.

BACKGROUND

Conventionally, various kinds of tape printers which can print on a print tape of a long printing medium, displaying a text composed of characters inputted with input means such as a keyboard, have been suggested. In the tape printer, the print tape is generally supplied from a tape cassette in which the print tape and an ink ribbon are wound on each spool and housed in a predetermined-shape cassette.

In a tape cassette housing part of the tape printer, there are provided a print head for printing on the print tape and a platen roller for feeding the tape. In printing, the print tape is pressed against the print head by the platen roller to be printed the text thereon, and discharged as a printed tape. Herein, in order that the tape cassette is removed and re-installed for replacement, the print head and the platen roller need to be moved away from a pressing position of the print tape in order to release pressure exerted on the print tape by the print head and the platen roller. Accordingly, at least one of the print head and the platen roller is made movable, and a release member is provided to move the print head or the platen roller between the pressing position and a withdrawing position. Further, a cassette cover for covering the tape cassette installed in the tape cassette housing part is also provided. In printing, the cassette cover is closed to prevent entry of something extraneous from outside.

Japanese Patent Application laid-open No. H10(1998)-100494 discloses, as the release member described above, an engagement member which is provided in the cover element for moving a holder member (the platen roller) to the pressing position when the cover element is closed, and an elastic member for moving the holder member (the platen roller) to the withdrawing position when the cassette cover is opened.

However, in the tape printer of the above publication, there is a risk that, while the tape printer is stored for a long period with the platen roller and the print head being in contact, the platen roller and the print head have adhered to each other, and they can be no longer returned to the withdrawing position with a force of repulsion. If the repulsion of the elastic member is enhanced to solve the problem, the holder member and the like need to be strengthened, which increase costs.

SUMMARY

At least some example aspects of the disclosure has been made in view of the above circumstances and has an object to overcome the above problems and to provide a tape printer which enables to forcibly separate a platen roller and a print head along with an opening movement of a cover element in case the platen roller and the print head have adhered to each other because of a long-period storage of the tape printer with the platen roller and the print head being in contact.

To achieve the purpose of the disclosure, there is provided a cassette holding part for removably holding a tape cassette housing a print tape therein; a print head for printing on the print tape; a platen roller placed to face the print head; a holder member for holding either one of the platen roller and the print head, and being movable between a first position in which the platen roller and the print head come into contact with each other, and a second position in which the platen roller and the print head are separated from each other; a cover element which is opened and closed over the holder member; an operation member constructed to be movable along with an opening and closing movement of the cover element, and to move the holder member to the first position during a closing operation of the cover element; and a forced movement device for forcing the holder member to move to the second position during an opening operation of the cover element.

The tape printer according to the first aspect is provided with the operation member for being movable along with an opening and closing movement of the cover element, and for moving the holder member to the first position in which the platen roller and the print head come into contact with each other during a closing operation of the cover element, and the forced movement device for moving the holder member to the second position in which the platen roller and the print head are separated from each other during the opening operation of the cover element. Accordingly, the forced movement device can move the holder member to the second position with the operation member when the cover element is opened, so that it is possible to separate between the print head and the platen roller which have adhered to each other because of the long-period storage of the tape printer in which the roller holder remains in the first position wherein the thermal head and the platen roller are in contact. This can avoid impossibility of setting the tape cassette in the cassette holding part and damage to the print tape and the ink ribbon.

DETAILED DESCRIPTION

Figure 1:
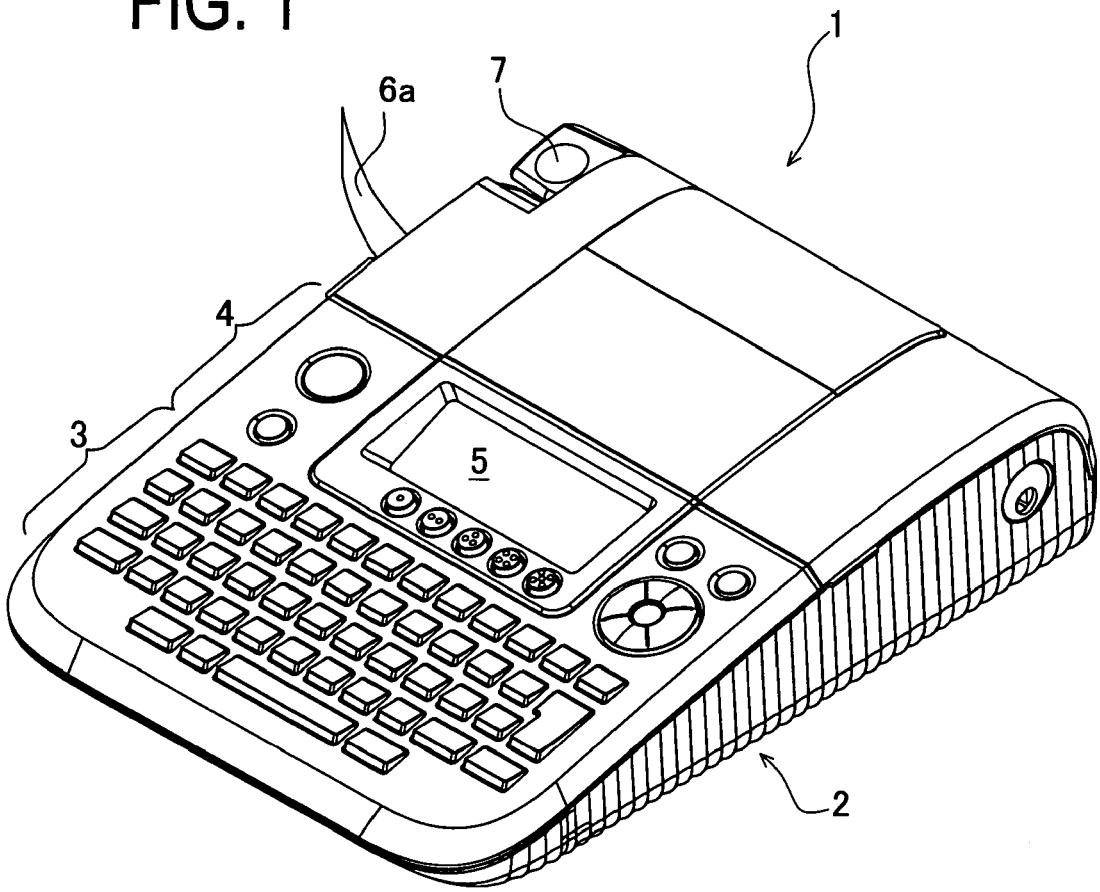
FIG. 1 is an external view of a tape printer in a first aspect of the disclosure.
Figure 2:
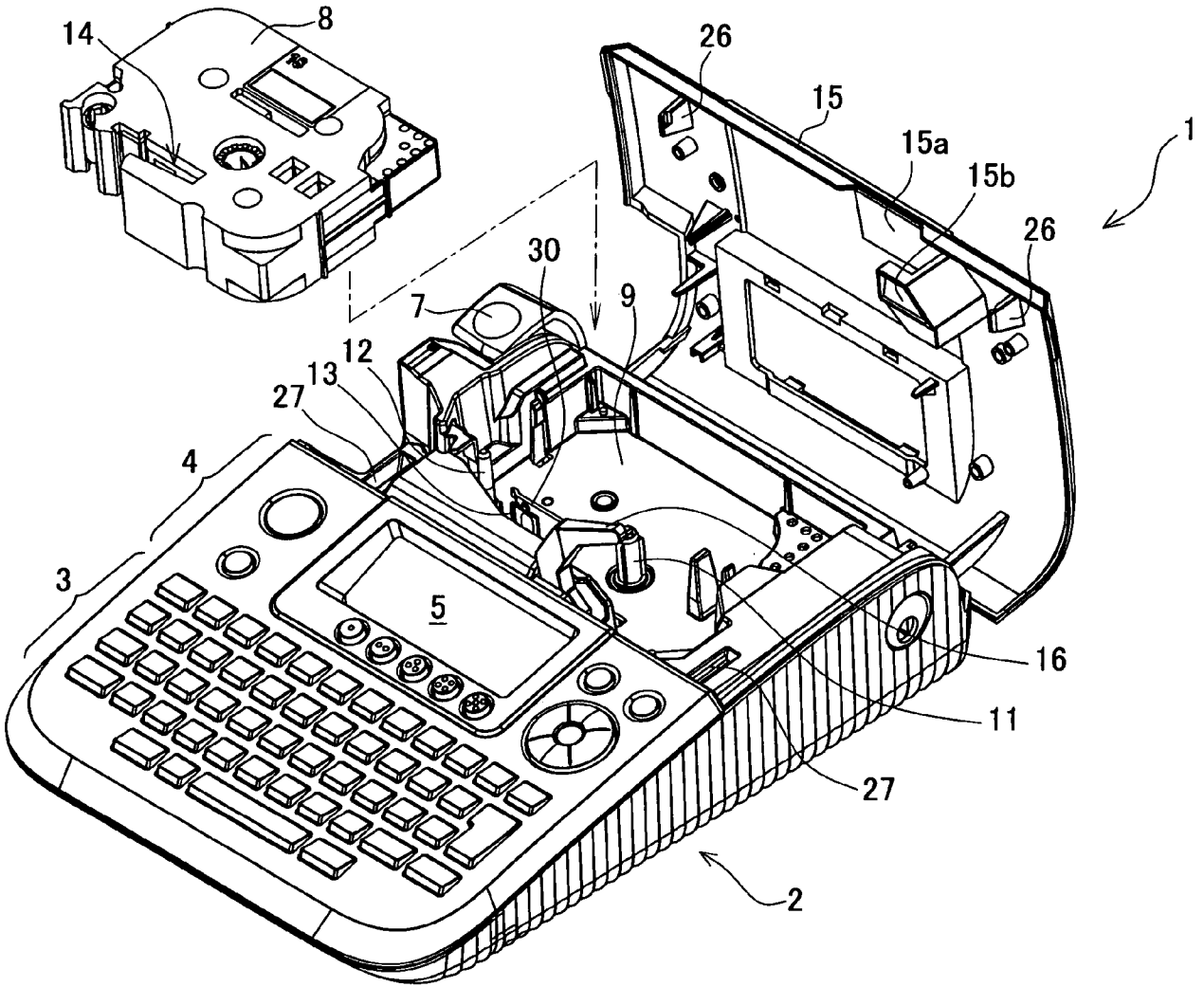
FIG. 2 is a perspective view of the tape printer with a cover element opened.
Figure 3:
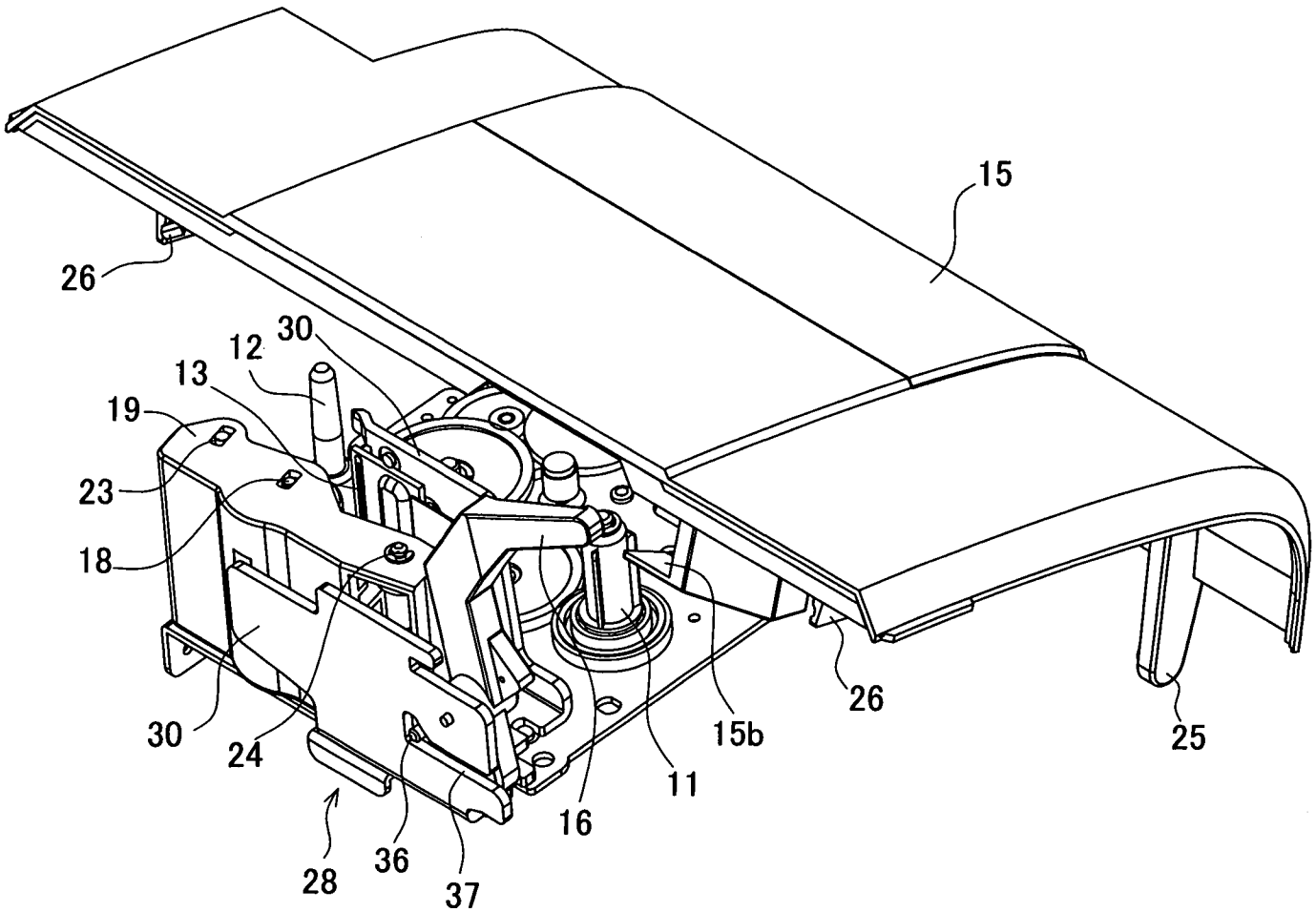
FIG. 3 is an enlarged perspective view of the cover element and a print mechanism.
Figure 4:
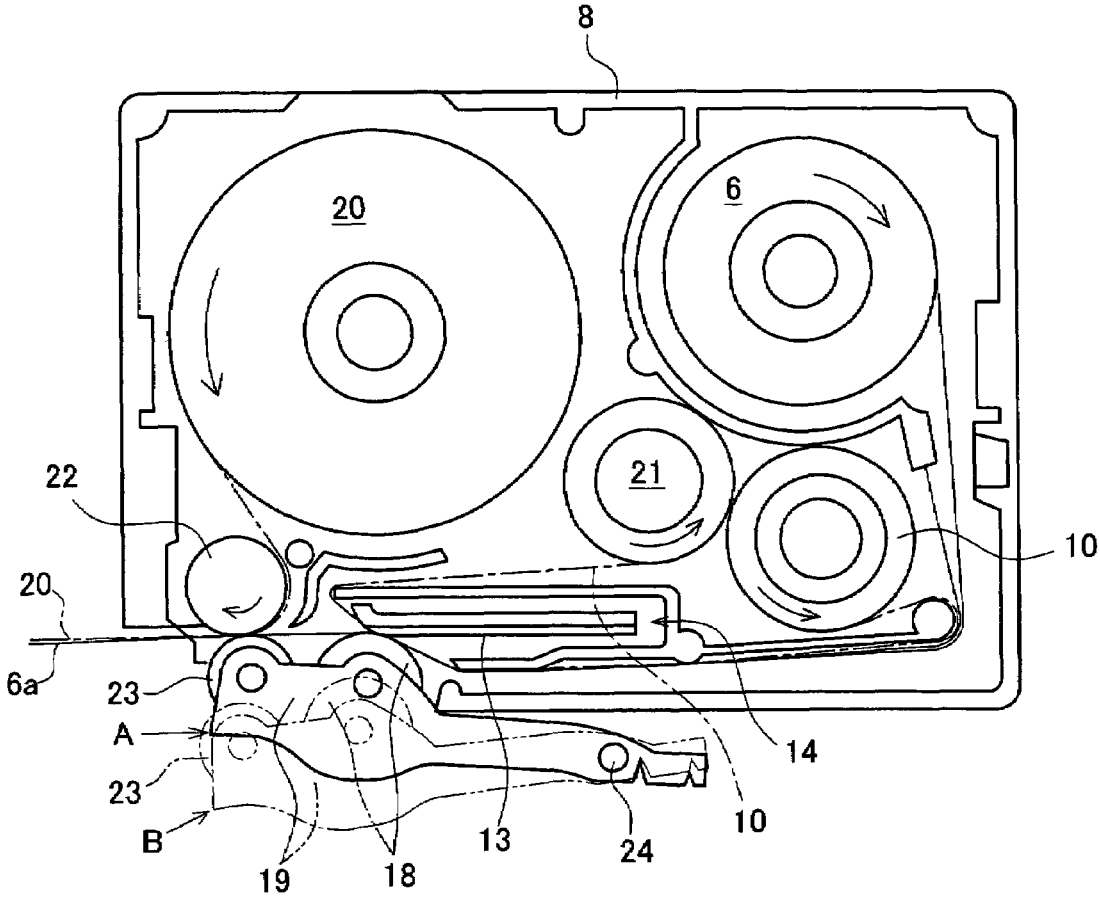
FIG. 4 is a schematic explanatory view of a relationship between a tape cassette and the print mechanism.

A detailed description of a first aspect of a tape printer embodying the disclosure will now be given referring to the accompanying drawings. Firstly, a schematic structure of the tape printer in the first aspect will be explained with reference to FIGS. 1 through 4. FIG. 1 is an external view of the tape printer in the first aspect of the disclosure. FIG. 2 is a perspective view of the tape printer with a cover element opened. FIG. 3 is an enlarged perspective view of the cover element and a print mechanism. FIG. 4 is a schematic explanatory view of a relationship between a tape cassette and the print mechanism.

As shown in FIG. 1, a tape printer 1 of the first aspect is provided with a keyboard 3, function keys 4, a liquid crystal display (hereinafter, a "LCD") 5, and a cutter lever 7. The keyboard 3, with which various kinds of characters are entered, is placed on a top face of a main body 2. Above the keyboard 3, there is provided the function keys 4 including a power switch and a print key for controlling the tape printer 1, and the LCD 5 for displaying the entered characters and symbols. The cutter lever 7 is provided at the upper left corner of the tape printer 1 for cutting a printed print tape 6*a* which is a print tape 6 on which printing is performed.

As shown in FIG. 2, a cassette holding part 9 is formed in a rear of the main body 2 to hold a tape cassette 8 (see FIG. 4) which houses the print tape 6 in a cassette case of a predetermined shape behind the LCD 5. In the cassette holding part 9, there are a ribbon take-up cam 11 for taking up a spent ink ribbon 10 in the tape cassette 8 and a tape feed roller cam 12 for feeding the printed print tape 6*a*. Additionally in the cassette holding part 9, a thermal head 13 for printing characters on the print tape 6 is attached to and arranged in a sub frame 30 for working also as a radiator so as to fit into an opening portion 14 of the tape cassette 8 when the tape cassette 8 is installed in the cassette holding part 9. As shown in FIG. 3, in a position facing the thermal head 13, a roller holder 19 holding a platen roller 18 and a pressing roller 23 is arranged together with a lever 16 so as to be turned about a holder shaft 24 with the lever 16 and an after-mentioned release rod 17.

As shown in FIGS. 2 and 3, the cassette holding part 9 is covered with a cover element 15 which is opened and closed. On the backside of the cover element 15, a lever pressing part 15*a* and an inferior lingulate hook 15*b* are positioned facing each other. The lever pressing part 15*a* is for pressing down the lever 16 when the cover element 15 is closed. The inferior lingulate hook 15*b* is for pulling up the lever 16 when the cover element 15 is opened. Further, engagement hooks 26, 26 are provided in both sides of the cover element 15. The engagement hooks 26, 26 are engaged with engagement members 27, 27 which are provided in the main body 2 of the tape printer 1 to keep the cover element 15 closed. Furthermore, supporting projection 25 which is extended from an end of the cover element 15 is provided as a supporting point for opening and closing the cover element 15.

Next, a structure of the tape cassette 8 will be explained with reference to FIG. 4, taking a laminated-tape cassette as an example. For explanation, FIG. 4 includes, in addition to the inner structure of the tape cassette 8, parts such as the thermal head 13 and the roller holder 19 which are portions of the print mechanism of the tape printer 1.

The tape cassette 8 houses the print tape 6, the ink ribbon 10, and a double-sided adhesive tape 20, which are rolled up in each of supply spools placed turnably. The print tape 6 of a predetermined width is made of a transparent film. The ink ribbon 10 is applied ink to be transferred to the print tape 6 on a front face thereof. The double-sided adhesive tape 20 of the same width as the print tape 6 adheres to the back face of the printed print tape 6*a*. Furthermore, there is placed a spent ink ribbon take-up spool 21 for taking up the spent ink ribbon 10. Inside the tape cassette 8, a tape feed roller 22 is built to discharge the printed print tape 6*a* to the outside of the tape cassette 8, and to stick the double-sided adhesive tape 20 on the back face of the printed print tape 6*a*.

When the tape cassette 8 is set into the cassette holding part 9 of the tape printer 1, the ribbon take-up cam 11 and the tape feed roller cam 12 in the cassette holding part 9 are fit into the spent ink ribbon take-up spool 21 and the tape feed roller 22 in the tape cassette 8 respectively. In printing, the spent ink ribbon take-up spool 21 and the tape feed roller 22 in the tape cassette 8 are rotated and driven. Accordingly, the print tape 6 and the ink ribbon 10 are unwound from each supply spool, overlapped each other, and fed to the thermal head 13 whereby performing a predetermined printing operation. After that, the spent ink ribbon 10 is separated from the printed print tape 6*a*, and wound on the spent ink ribbon take-up spool 21. The printed print tape 6*a* adheres to the supplied double-sided adhesive tape 20, and is discharged outward with the tape feed roller 22.

Next, a structure for pressing the print tape 6 against the thermal head 13 in printing will be explained. As mentioned above, the thermal head 13 provided in the cassette holding part 9 as in FIG. 2 is arranged to fit into the opening portion 14 of the tape cassette 8 when the tape cassette 8 is installed. The platen roller 18 is placed to face the thermal head 13, interposing the print tape 6 therebetween. A pressing roller 23 is placed facing the tape feed roller 22 of the tape cassette 8. The platen roller 18 and the pressing roller 23 are rotatably attached to the roller holder 19 which is turnably mounted on a holder shaft 24. As the roller holder 19 pivots, the platen roller 18 and the pressing roller 23 are set in either a pressing position A (indicated with a solid line) or a withdrawing position B (indicated with a two-dotted chain line). The pressing position A is the position wherein the platen roller 18 and the pressing roller 23 are pressed against the thermal head 13 and the tape feed roller 22 respectively. The withdrawing position B is the position wherein the rollers 18 and 23 are moved away from the thermal head 13 and the tape feed roller 22.

Figure 5:
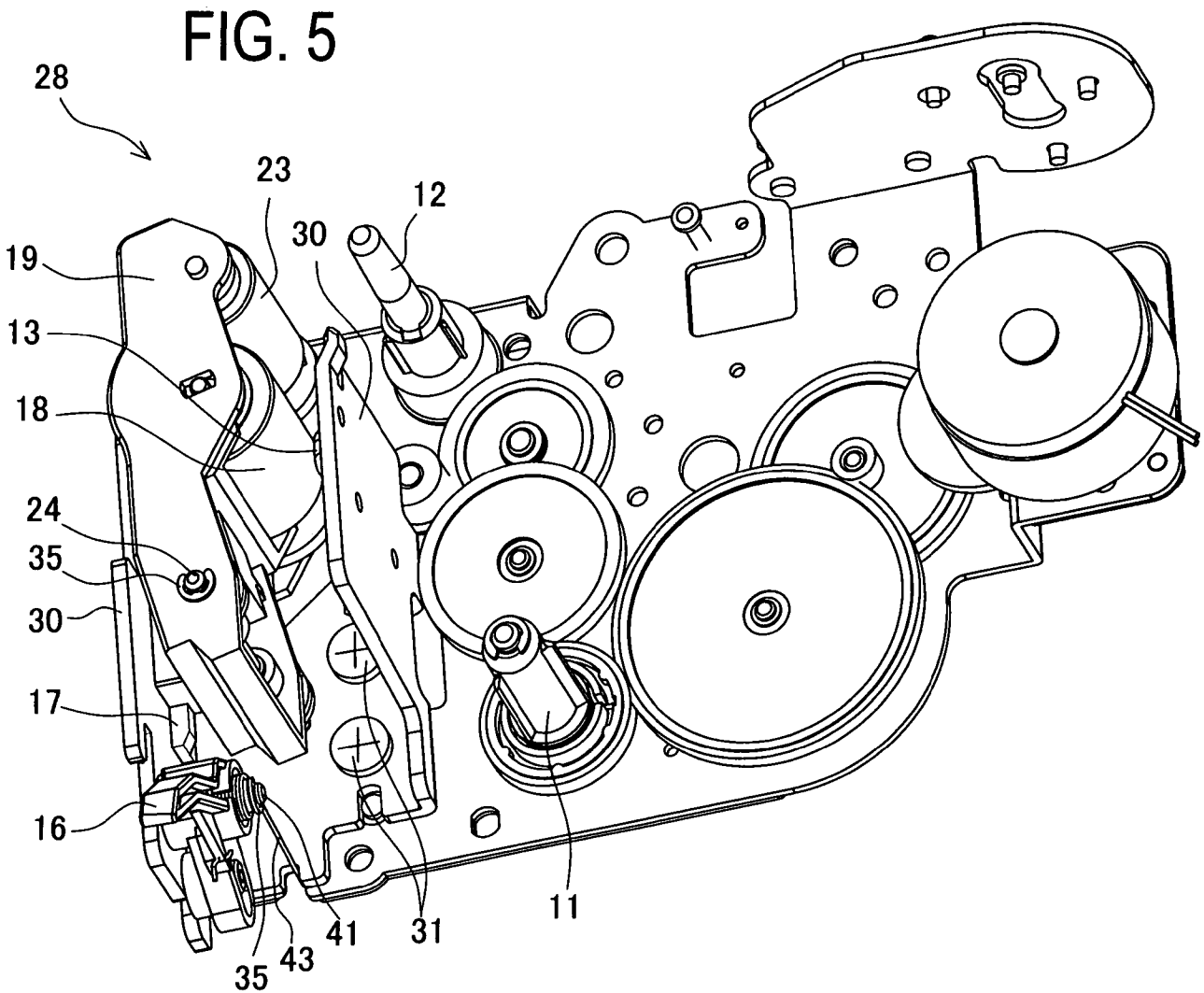
FIG. 5 is an enlarged perspective view of the print mechanism.
Figure 6:
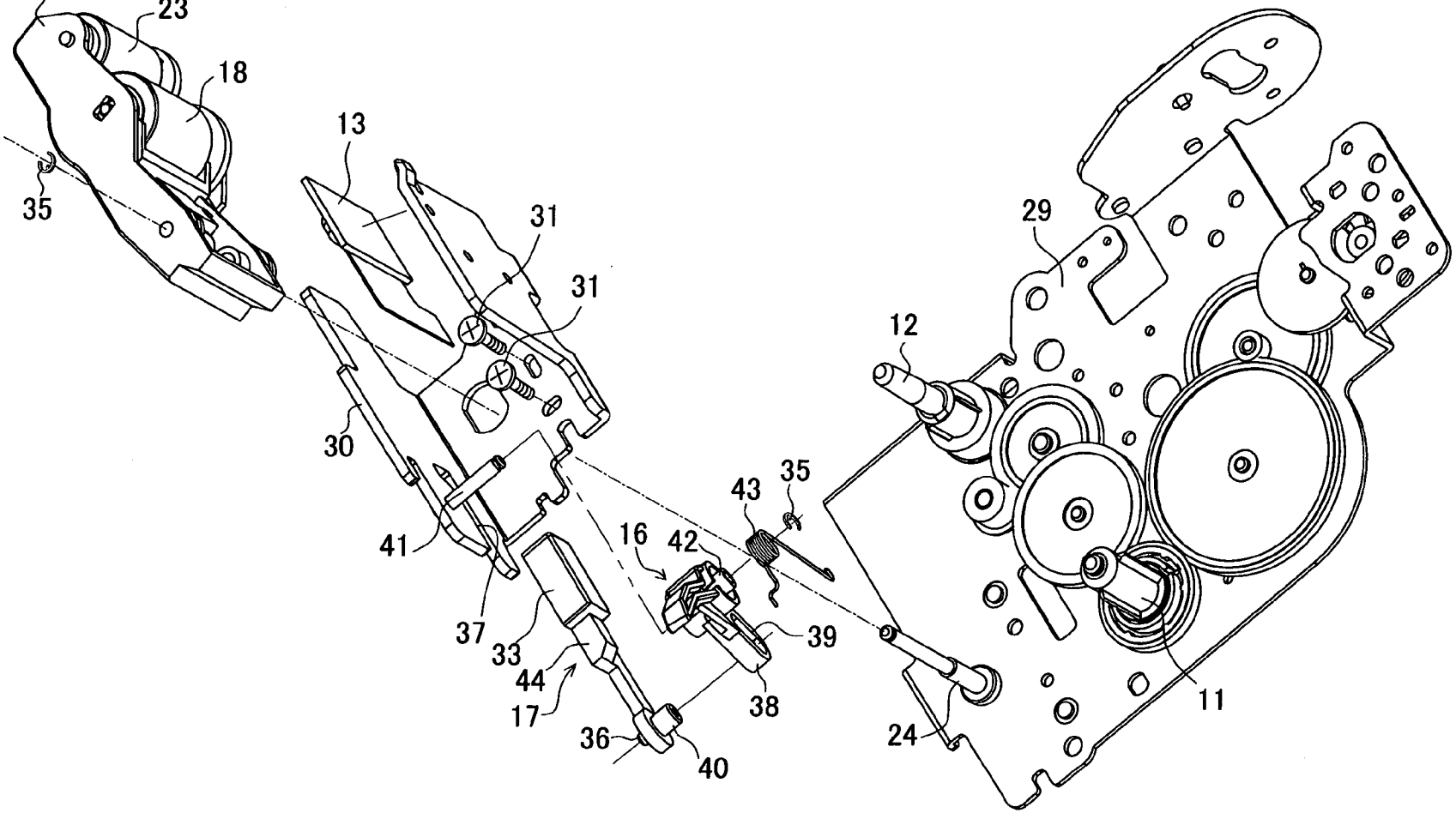
FIG. 6 is an exploded perspective view of the print mechanism.
Figure 7A:
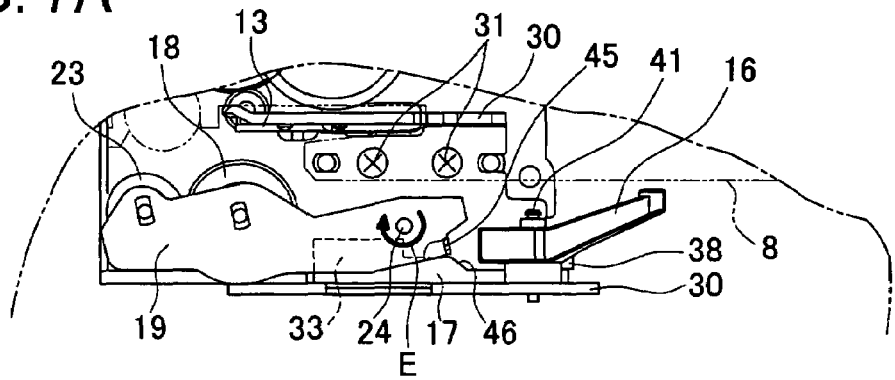
FIG. 7A is an explanatory top view of a relationship between the cover element, a lever, a release rod, and a roller holder when the cover element is opened.
Figure 7B:
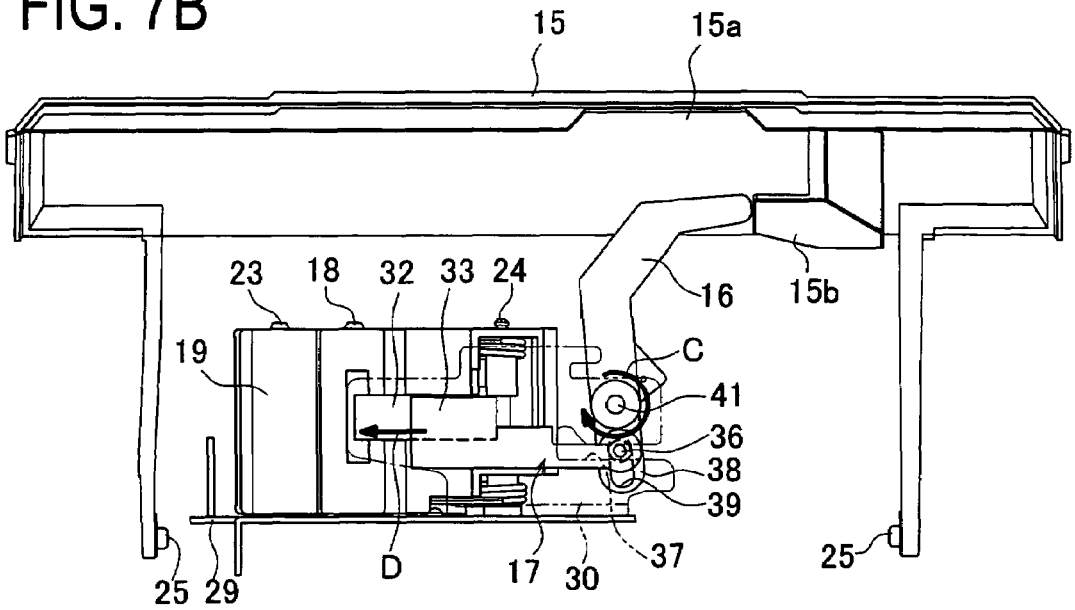
FIG. 7B is an explanatory front view of the relationship between the cover element, the lever, the release rod, and the roller holder when the cover element is opened.
Figure 8A:
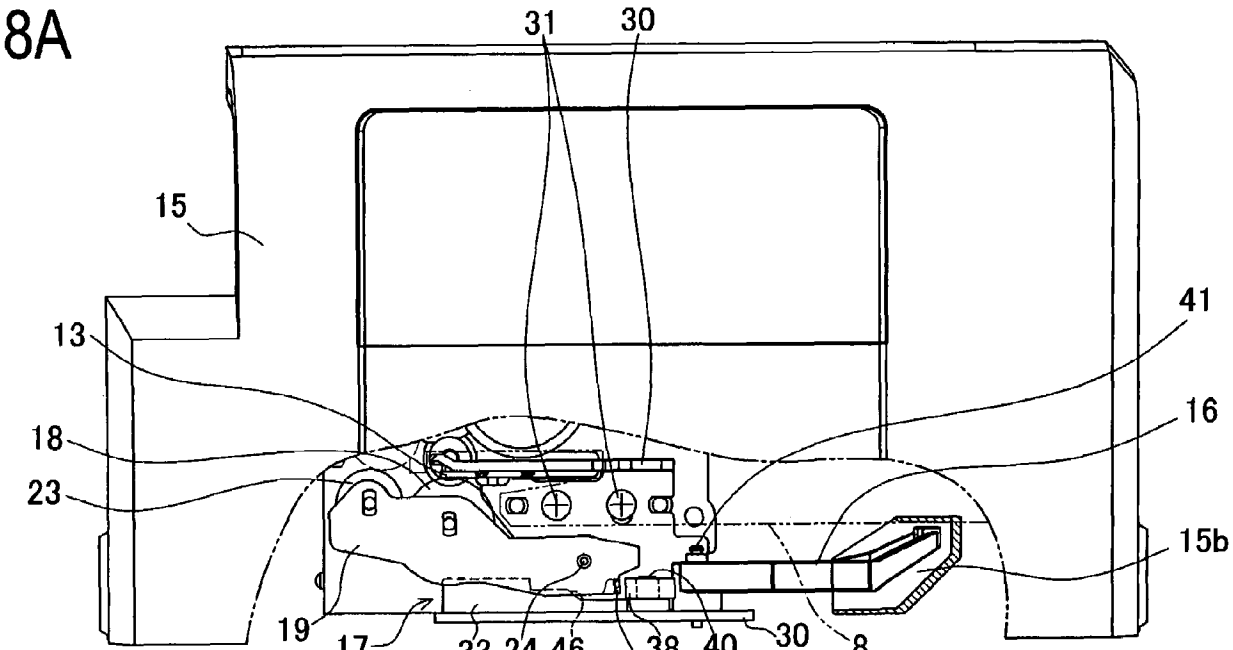
FIG. 8A is an explanatory top view of the relationship between the cover element, the lever, the release rod, and the roller holder when the cover element is closed.
Figure 8B:
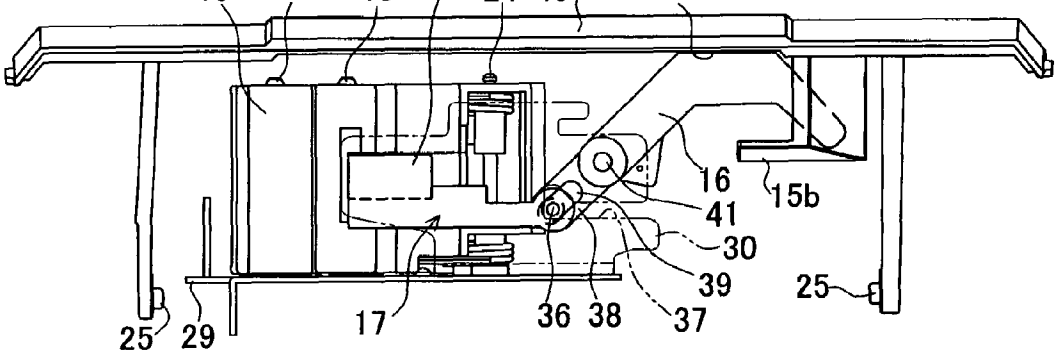
FIG. 8B is an explanatory front view of the relationship between the cover element, the lever, the release rod, and the roller holder when the cover element is closed.

A structure for performing a pressure and a separation between the platen roller 18 and the thermal head 13, and the pressing roller 23 and the tape feed roller 22 by opening and closing the cover element 15 which covers the cassette holding part 9 will be explained referring to FIGS. 2, 3, and 5 through 8B. FIG. 5 is an enlarged perspective view of the print mechanism. FIG. 6 is an exploded perspective view of the print mechanism. FIG. 7A is an explanatory top view of a relationship between the cover element, the lever, the release rod, and the roller holder when the cover element is opened. FIG. 7B is an explanatory front view of the relationship between the cover element, the lever, the release rod, and the roller holder when the cover element is opened. FIG. 8A is an explanatory top view of the relationship between the cover element, the lever, the release rod, and the roller holder when the cover element is closed. FIG. 8B is an explanatory front view of the relationship between the cover element, the lever, the release rod, and the roller holder when the cover element is closed.

The cover element 15 capable of being opened and closed, as shown in FIGS. 2 and 3, covers the cassette holding part 9. The cover element 15 is attached to the main body 2 of the tape printer 1 with supporting projections 25, 25, and is opened and closed over the cassette holding part 9 by pivoting about the supporting projections 25, 25 as shown in FIG. 3. The engagement hooks 26, 26 are provided at both sides of the cover element 15. The engagement hooks 26, 26 are engaged with engagement members 27, 27 which are provided in the main body 2 of the tape printer 1 to keep the cover element 15 closed. The engagement hooks 26, 26 are elastic, so that predetermined operation can disengage them, and then open the cover element 15.

A print mechanism 28 as shown in FIG. 5 is placed in the cassette holding part 9 which is covered with the cover element 15. The print mechanism 28 is assembled as follows referring to FIG. 6. Firstly, the sub frame 30 which is functioning also as a radiator plate and attached with the thermal head 13, is secured to a main frame 29 by screws 31, 31, being penetrated the holder shaft 24 mounted on the main frame 29. Next, the roller holder 19 which has the platen roller 18 and the pressing roller 23 is turnably mounted on the holder shaft 24 and secured by an E-shaped stopper ring 35, fitting a fitting part 33 provided at one end of the release rod 17 into an after-mentioned fitting groove 32 provided in a backside of the roller holder 19. At the same time, a sliding pin 36 provided at the other end of the release rod 17 is slidably fitted into a pin sliding slot 37 in the sub frame 30. After that, the lever 16 is turnably attached to a lever shaft 41 provided horizontally to the sub frame 30, while a sliding shaft 40 provided at the other end of the release rod 17 and the side opposite to the sliding pin 36, is engaged in a shaft sliding hole 39 provided at the other end of the lever 16. Further, a lever return spring 43 is fit into a spring attach shaft 42 of the lever 16, and kept in a predetermined position to be fastened by the E-shaped stopper ring 35 to the lever shaft 41. Finally, the print mechanism 28 has been completely assembled.

A process of using the tape printer 1 comprising the print mechanism 28 will now be explained with reference to FIGS. 7A through 8B. Firstly, the tape cassette 8 is installed in the cassette holding part 9. To be closed, the cover element 15 is pressed down and the engagement hooks 26, 26 are engaged with the engagement members 27, 27. During the closing operation, the print mechanism 28 functions as follows- As the cover element 15 is being closed, the one end of the lever 16 is fit into a space between the lever pressing part 15*a* provided on the backside of the cover element 15 and the inferior lingulate hook 15*b* provided integrally with the cover element 15. The lever pressing part 15*a* presses the one end of the lever 16, and the lever 16 is turned down along an arrow C centering on the lever shaft 41. It is noted that the lever 16 needs to be always forced toward the opposite direction of the arrow C with the lever return spring 43 (see. FIG. 6) so that the one end of the lever 16 is fit into the space between the lever pressing part 15*a* and the inferior lingulate hook 15*b* when the cover element 15 is closed.

At an end 38 of the other end of the lever 16, there is provided the shaft sliding hole 39, to which the sliding shaft 40 of the other end of the release rod 17 is slidably attached. The shaft sliding hole 39 and the sliding shaft 40 converts a rotational movement of the lever 16 into a horizontal linear movement of the release rod 17. With the horizontal linear movement, the sliding pin 36 at the other end of the release rod 17 slides in the pin sliding slot 37 provided in the sub frame 30, and the fitting part 33 provided at the one end of the release rod 17 slides in the abovementioned fitting groove 32 provided in the backside of the roller holder 19. Hence, the rotational movement of the lever 16 along the arrow C is converted into the horizontal linear movement of the release rod 17 in the direction of the arrow D.

When the aforesaid release rod 17 further continues the horizontal linear movement in the direction of the arrow D, the roller holder 19 is pressed by the fitting part 33 of the release rod 17, turned about the holder shaft 24 along the arrow E, and set in the pressing position A (see FIG. 4). Therefore, when the cover element 15 is closed, the roller holder 19 is always set in the pressing position A, and brought into a printable condition without any special operation for setting.

To remove the tape cassette 8 from the cassette holding part 9 after printing, the engagement hooks 26, 26 of the cover element 15 are directly pulled up by fingers to open the cover element 15 without any special release operation. Specifically, the one end of the lever 16, which is fitted in the space between the lever pressing part 15*a* provided on the backside of the cover element 15 and the inferior lingulate hook 15*b* provided integrally with the cover element 15, is pulled up by the inferior lingulate hook 15*b*, and the lever 16 is turned about the lever 41 reversely along the arrow C.

Further, the rotational movement of the lever 16 to rotate reversely along the arrow C is converted into the horizontal linear movement of the release rod 17 to the direction opposite to the arrow D, with an engagement with the shaft sliding hole 39 of the lever 16 and the sliding shaft 40 of the release rod 17.

When the release rod 17 further continues the abovementioned horizontal linear movement to the direction opposite to the arrow D, the roller holder 19 is released from a pressure from the fitting part 33 of the release rod 17. The roller holder 19 is moved and rotated about the holder shaft 24 reversely along the arrow E, and is set in the withdrawing position B (see FIG. 4), since a cam receiver 45 of the roller holder 19 is pressed by a cam face 46 and a top part 47 of a cam pressing member 44 of the release rod 17. Therefore, the tape cassette 8 can be removed or installed as soon as the cover element 15 is opened. In other words, only one operation can work both for installing and removing the tape cassette 8.

Figure 9A:
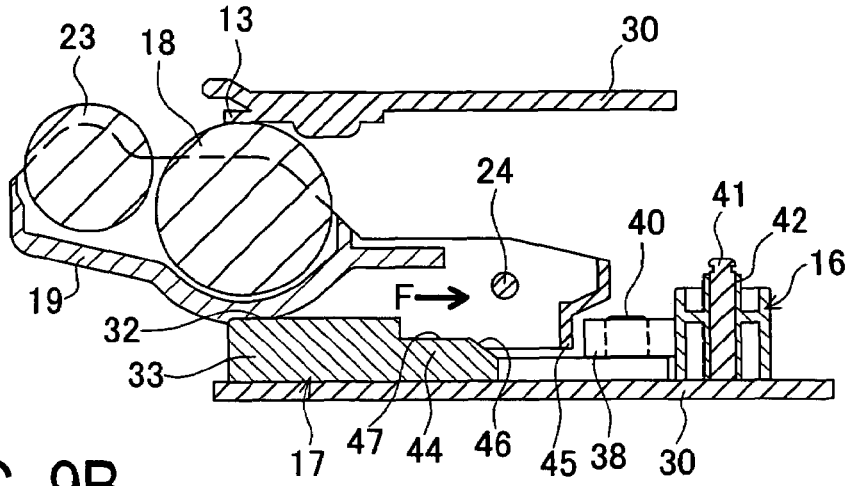
FIG. 9A is an explanatory view of a separation process between the thermal head and the platen roller which have adhered to each other when the cover element is completely closed.
Figure 9B:
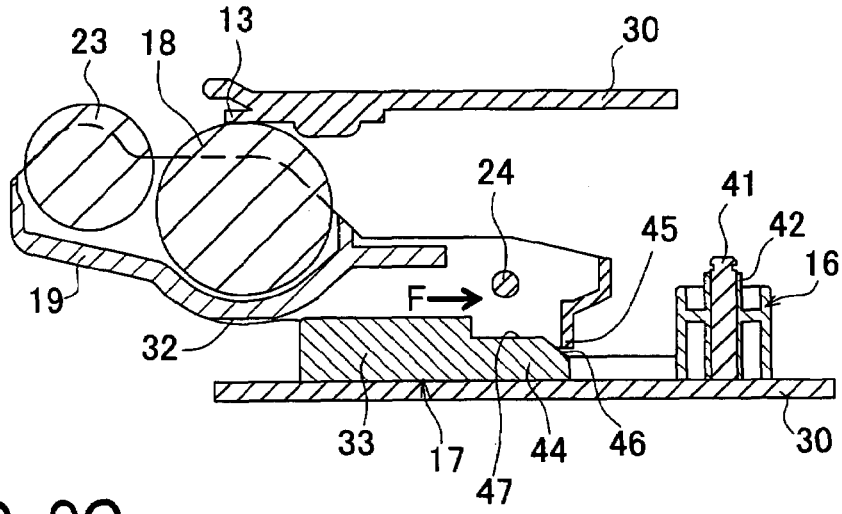
FIG. 9B is an explanatory view of the separation process between the thermal head and the platen roller which have adhered to each other when the thermal head and the platen roller adhere to each other.
Figure 9C:
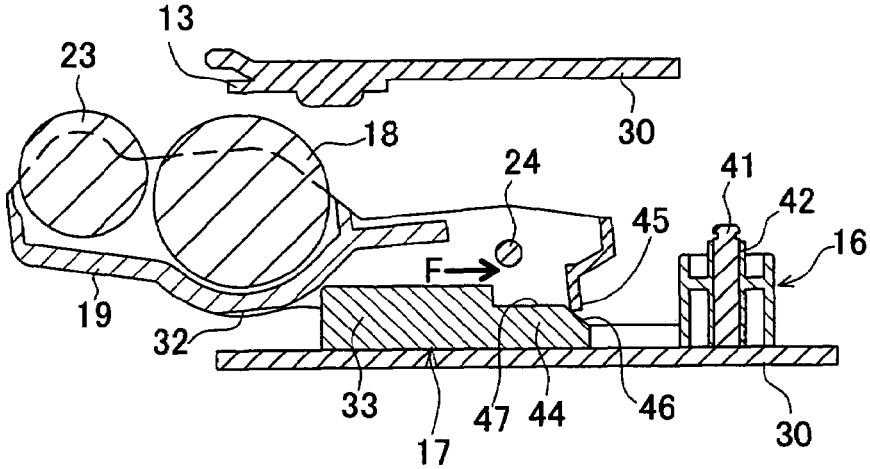
FIG. 9C is an explanatory view of the separation process between the thermal head and the platen roller which have adhered to each other when the platen roller becomes separated from the thermal head by a separation operation.
Figure 10A:
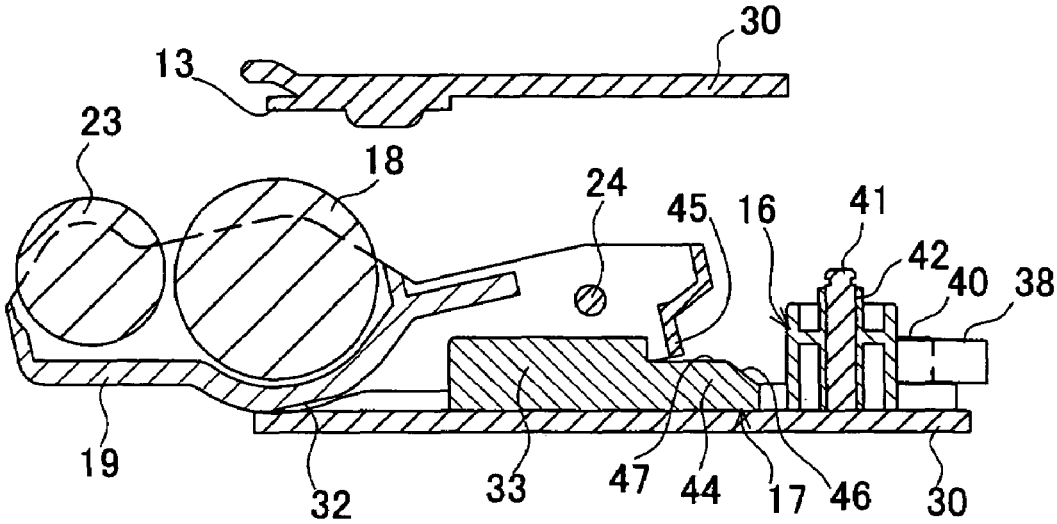
FIG. 10A is an explanatory view of the separation process between the thermal head and the platen roller which have adhered to each other when the cover element is completely opened.
Figure 10B:
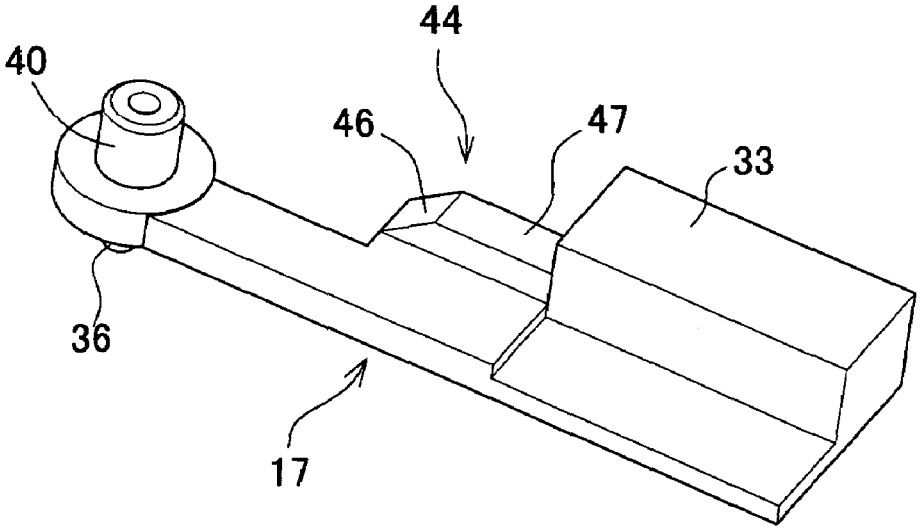
FIG. 10B is a perspective view of the release rod which is used in FIGS. 9A through 10A.

Next, a process of separation between the thermal head 13 and the platen roller 18 which have adhered to each other after the tape printer 1 is stored for a long period with the roller holder 19 set in the pressing position A and the tape cassette 8 uninstalled will be explained in detail with reference to FIGS. 9A through 10B. FIG. 9A is an explanatory view of the separation process between the thermal head and the platen roller which have adhered to each other when the cover element is completely closed. FIG. 9B is an explanatory view of the separation process between the thermal head and the platen roller which have adhered to each other when the thermal head and the platen roller adhere to each other. FIG. 9C is an explanatory view of the separation process between the thermal head and the platen roller which have adhered to each other when the platen roller becomes separated from the thermal head by a separation operation. FIG. 10A is an explanatory view of the separation process between the thermal head and the platen roller which have adhered to each other when the cover element is completely opened. FIG. 10B is a perspective view of the release rod which is used in FIGS. 9A through 10A.

In FIG. 9A, the cover element 15 is closed. The fitting part 33 of the release rod 17 (see FIG. 10B) presses against the roller holder 19, sliding in the fitting groove 32 provided in the roller holder 19. The thermal head 13 and the platen roller 18 are brought into absolute contact with each other with the tape cassette 8 uninstalled, and set in the pressing position A (see FIG. 4).

In FIG. 9B, the release rod 17 starts to be moved to the direction of an arrow F as the cover element 15 is opened after a long-period storage in the state of FIG. 9A. However, the thermal head 13 and the platen roller 18 can be hardly separated, since they have strictly adhered to each other.

In FIG. 9C, as the cover element 15 is further opened, the release rod 17 continues to be moved to the direction of the arrow F. The cam face 46 of the cam pressing member 44 comprising the cam face 46 formed integrally with the release rod 17 and the top part 47 starts to contact with the cam receiver 45 integrally provided in the roller holder 19. As a result, the roller holder 19 is turned about the holder shaft 24 reversely along the arrow E (see FIG. 7). The roller holder 19 is forcibly turned by the release rod 17 to the direction of the arrow F with the release rod 17 moved to the arrow F. Accordingly, the thermal head 13 and the platen roller 18 which have adhered can be securely separated from each other.

In FIG. 10A, the cover element 15 is fully opened. The cam face 46 of the cam pressing member 44 of the release rod 17 presses against the cam receiver 45 of the roller holder 19, and then the thermal head 13 and the platen roller 18 which have adhered to each other can be forcibly separated. Additionally, FIG. 10A shows the state in which the roller holder 19 is set in the withdrawing position B (see FIG. 4) by the top part 47 of the cam pressing member 44 of the release rod 17. As has been described, the thermal head 13 and the platen roller 18 which have adhered to each other can be forcibly separated along with the contact between the cam face 46 of the cam pressing member 44 of the release rod 17 and the cam receiver 45 of the roller holder 19. Furthermore, the roller holder 19 can be set in the withdrawing position B by the top part 47 of the cam pressing member 44 of the release rod 17 without the elastic member which is usually used to set the roller holder 19 in the withdrawing position B. Consequently, a decrease of the number of parts and a reduction of the cost can be achieved.

As described in detail above, the tape printer 1 of the first aspect comprises the cam pressing member 44 which is formed in the release rod 17, presses against the cam receiver 45 of the roller holder 19 when the cover element 15 is opened, and moves the roller holder 19 to the withdrawing position B wherein the platen roller 18 and the thermal head 13 which have adhered to each other can be separated. Accordingly, it becomes possible to separate the platen roller 18 and the thermal head 13 which have adhered to each other because of the long-period storage of the tape printer 1 in which the roller holder 19 remains in the pressing position A wherein the thermal head 13 and the platen roller 18 are in contact. Therefore, this can avoid impossibility of setting the tape cassette 8 in the cassette holding part 9 and damage to the point tape 6 and the ink ribbon 10. Furthermore, the roller holder 19 can be moved to the withdrawing position B without the elastic member for moving the roller holder 19 to the withdrawing position B, and the cam pressing member 44 can be formed integrally with the release rod 17, which can reduce the cost.

Figure 11A:
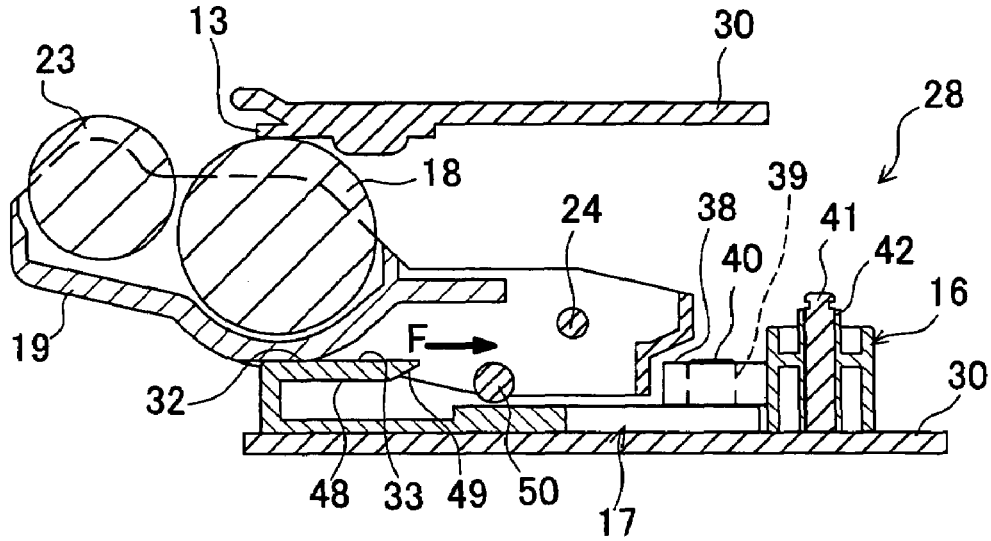
FIG. 11A is an explanatory view of the separation process between the thermal head and the platen roller which have adhered to each other when the cover element is completely closed.
Figure 11B:
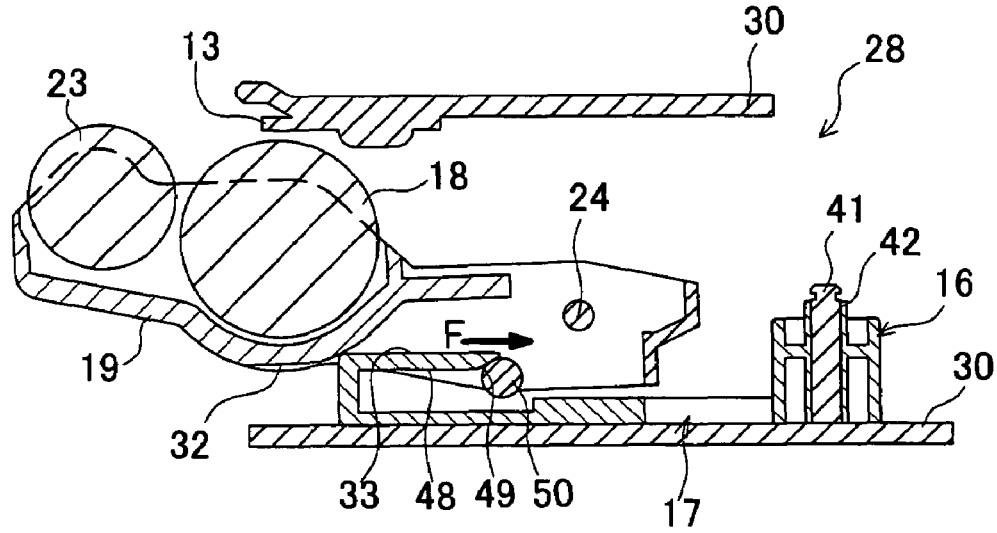
FIG. 11B is an explanatory view of the separation process between the thermal head and the platen roller which have adhered to each other when the thermal head and the platen roller adhere to each other.
Figure 12A:
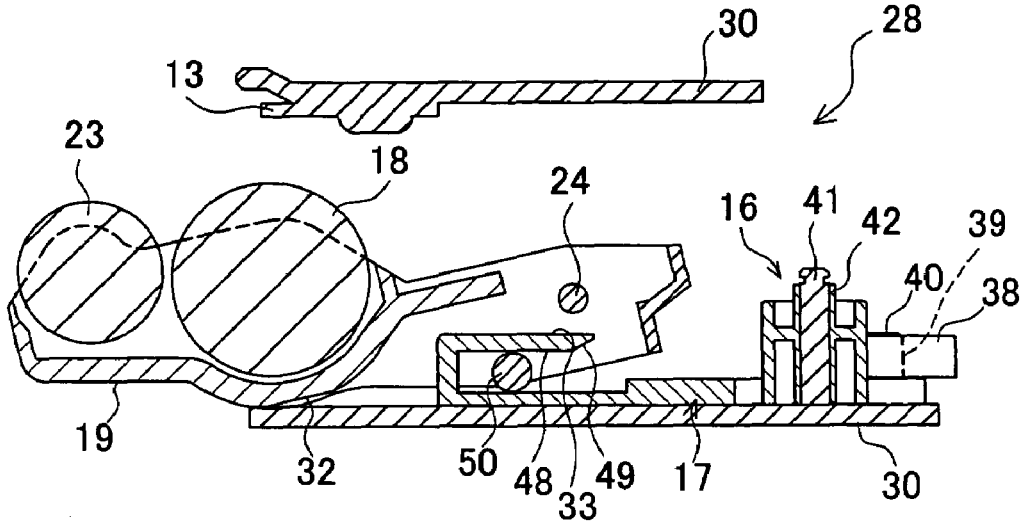
FIG. 12 A is an explanatory view of the separation process between the thermal head and the platen roller which have adhered to each other when the cover element is completely opened.
FIG. 12B is a perspective view of the release rod which is used in FIGS. 11A through 12A.
Figure 12B:
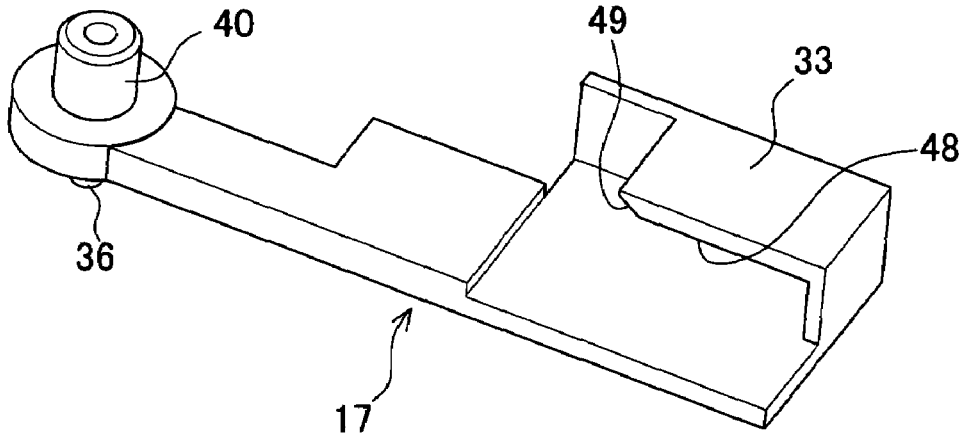

A second aspect of the disclosure will now be explained with reference to FIGS. 11A through 12B. The structure of the tape printer of the second aspect is same as that of the tape printer 1 of the first aspect. However, the direction of the force applied to the roller holder 19 by the forced movement device in the second aspect is completely opposite to the direction in the first aspect, when the roller holder 19 is moved to the withdrawing position B. FIG. 11A is an explanatory view of the separation process between the thermal head and the platen roller which have adhered to each other when the cover element is completely closed. FIG. 11B is an explanatory view of the separation process between the thermal head and the platen roller which have adhered to each other when the thermal head and the platen roller adhere to each other. FIG. 12A is an explanatory view of the separation process between the thermal head and the platen roller which have adhered to each other when the cover element is completely opened. FIG. 12B is a perspective view of the release rod which is used in FIGS. 11A through 12A. Parts which are functionally the same as those in the first aspect are assigned the identical reference numerals to those in the first aspect.

Firstly, the structure of the print mechanism 28 is explained referring to FIG. 11A. As shown in FIG. 11A, the thermal head 13 is provided at one end (on the upper side in FIG. 11A) of both ends of the sub frame 30 facing each other. The lever shaft 41 to which the lever 16 is turnably attached is provided at the other end (on the lower side in FIG. 11A) of the sub frame 30. The sliding shaft 40 which is provided at the other end of the release rod 17 (see FIG. 12B) having the fitting part 33 at the one end is slidably engaged into the shaft sliding hole 39 provided at the end 38 of the lever 16. The release rod 17 can slide to the direction of the arrow F or the opposite direction, depending on the turning direction of the lever 16. Further, an engagement groove 48 which is open toward the other end of the release rod 17 is formed inward on the fitting part 33 which is integrally provided in the one end of the release rod 17. When the release rod 17 is moved to the direction of the arrow F, a projection member 50 integrally provided in the roller holder 19 is engaged with the engagement groove 48. At the end of the opened side of the engagement groove 48, there is an engagement cam face 49 to engage the projection member 50 provided in the roller holder 19 in the engagement groove 48. The roller holder 19 to which the platen roller 18 and the pressing roller 23 are attached is turnably mounted on the holder shaft 24 between the both ends of the sub frame 30. Accordingly, the roller holder 19 is turned about the holder shaft 24 between the both ends of the sub frame 30, in accordance with the turning movement of the release rod 17 with the fitting part 33 and the engagement groove 48 at the one end of the release rod 17.

Next, a process of forced movement will be explained with reference to FIGS. 11A through 12B.

In FIG. 11A, the cover element 15 is closed. The fitting part 33 of the release rod 17 presses against the roller holder 19, sliding in the fitting groove 32. The thermal head 13 and the platen roller 18 are brought into absolute contact with each other, and set in the pressing position A (see FIG. 4). After the tape printer 1 is stored for a long period under this state, despite the release rod 17 is moved to the direction of the arrow F, and the fitting part 33 of the release rod 17 slides out of the fitting groove 32, the thermal head 13 has stuck to the platen roller 18 and they become hardly separated from each other.

In FIG. 11B, the cover element 15 is being opened. The engagement cam face 49 in the edge of the engagement groove 48 provided inward on the fitting part 33 formed integrally with the release rod 17 starts to come into contact with the projection member 50 formed integrally with the roller holder 19, while the release rod 17 is moved to the direction of the arrow F. The engagement cam face 49 in the edge of the engagement groove 48 comes into contact with, and presses against the projection member 50 so as to pull the roller holder 19 back. The roller holder 19 is turned about the holder shaft 24 reversely along the arrow E (see FIG. 7A). The roller holder 19 is forcibly turned along with the movement of the release rod 17 to the direction of the arrow F, the thermal head 13 and the platen roller 18 which have been stuck to each other can be free from the contact therebetween, and be surely separated.

In FIG. 12A, the cover element 15 is completely opened. The engagement cam face 49 of the engagement groove 48 of the release rod 17 comes into contact with the projection member 50 of the roller holder 19. The thermal head 13 and the platen roller 18 which have adhered to each other are surely separated, while the engagement cam face 49 presses against the projection member 50 so as to pull the roller holder 19 back. After that, as the release rod 17 is further moved to the direction of the arrow F, the projection member 50 slides in the engagement groove 48, which brings the roller holder 19 to set in the withdrawing position B (see FIG. 4). As a result, the elastic member which is usually used to set the roller holder 19 in the withdrawing position B can be eliminated, which can decrease the number of parts, and reduce the cost.

As described in detail above, the tape printer 1 of the second aspect comprises the projection member 50 provided in the roller holder 19 and the engagement groove 48 which is formed in the release rod 17 and possible to engage with the projection member 50. The roller holder 19 is moved to the withdrawing position B in which the platen roller 18 and the thermal head 13 are separated from each other along with the engagement of the engagement groove 48 with the projection member 50 as the cover element 15 is opened. Consequently, it becomes possible to separate between the thermal head 13 and the platen roller 18 which have adhered to each other because of the long-period storage of the tape printer 1 in which the roller holder 19 remains in the pressing position A wherein the thermal head 13 and the platen roller 18 are in contact. This can avoid impossibility of setting the tape cassette 8 in the cassette holding part 9 and damage to the point tape 6 and the ink ribbon 10. Furthermore, the roller holder 19 can be set in the withdrawing position B by the top part 47 of the cam pressing member 44 of the release rod 17 without the elastic member which is usually used to set the roller holder 19 in the withdrawing position B. Consequently, a decrease of the number of parts and a reduction of the cost can be achieved.

The disclosure may be embodied in other specific forms without departing from the essential characteristics thereof. For instance, in the first and second aspects, the thermal head 13 is fixed, and the roller holder 19 comprising the platen roller 18 is movable. The thermal head 13 may be movable.

While the aspect of the disclosure has been shown and described, it is to be understood that this disclosure is for the purpose of illustration and that various changes and modifications may be made without departing from the scope of the disclosure as set forth in the appended claims.

What is claimed is:

1. A tape printer comprising:

a cassette holding part for removably holding a tape cassette housing a print tape therein;

a print head for printing on the print tape;

a platen roller placed to face the print head;

a holder member for holding either one of the platen roller and the print head, and being movable between a first position in which the platen roller and the print head come into contact with each other, and a second position in which the platen roller and the print head are separated from each other;

a cover element which is opened and closed over the holder member;

an operation member constructed to be movable along with an opening and closing movement of the cover element, and to move the holder member to the first position during a closing operation of the cover element; and a forced movement device moveable in a linear direction to force the holder member to move to the second position during an opening operation of the cover element.

2. A tape printer comprising:

a cassette holding part for removably holding a tape cassette housing a print tape therein;

a print head for printing on the print tape;

a platen roller placed to face the print head;

a holder member for holding either one of the platen roller and the print head, and being movable between a first position in which the platen roller and the print head come into contact with each other, and a second position in which the platen roller and the print head are separated from each other;

a cover element which is opened and closed over the holder member;

an operation member constructed to be movable along with an opening and closing movement of the cover element, and to move the holder member to the first position during a closing operation of the cover element; and a forced movement device for forcing the holder member to move to the second position during an opening operation of the cover element, the forced movement device comprising a cam pressing member which is formed in the operation member to move the holder member to the second position by pressing a part of the holder member during the opening operation of the cover element.

3. The tape printer according to claim 2, wherein the cam pressing member is formed integrally with the operation member.

4. The tape printer according to claim 2, wherein the forced movement device fixes the holder member on the second position side with a top part which is adjacent to the cam pressing member.

5. The tape printer according to claim 2, wherein the cam pressing face starts to press a part of the holder member when a fitting part provided in the operation member becomes disengaged from a fitting groove during the opening operation of the cover element.

6. A tape printer comprising:

a cassette holding part for removably holding a tape cassette housing a print tape therein;

a print head for printing on the print tape;

a platen roller placed to face the print head;

a holder member for holding either one of the platen roller and the print head, and being movable between a first position in which the platen roller and the print head come into contact with each other, and a second position in which the platen roller and the print head are separated from each other;

a cover element which is opened and closed over the holder member;

an operation member constructed to be movable along with an opening and closing movement of the cover element, and to move the holder member to the first position during a closing operation of the cover element; and a forced movement device for forcing the holder member to move to the second position during an opening operation of the cover element, forced movement device comprising a projection member provided in the holder member and an engagement groove which is engageable with the projection member, and the holder member is moved to the second position as the engagement groove becomes engaged with the projection member when the cover element is opened.

7. The tape printer according to claim 6, wherein the engagement groove is formed integrally with the operation member.

8. The tape printer according to claim 6, wherein the holder member is arranged to be fixed on the second position side with the engagement groove.

9. The tape printer according to claim 6, wherein the engagement groove starts to engage with the projection member when a fitting part provided in the operation member becomes disengaged from a fitting groove during the opening operation of the cover element.

10. The tape printer according to claim 6, wherein the engagement groove provided in the operation member is formed with a cam-shaped face at an end of an engagement side of the engagement groove which starts to engage with the projection member provided in the holder member when the cover element is opened.

11. A tape printer comprising:

a platen roller placed to face a print head;

a holder that holds either the platen roller or the print head, the holder being movable between a first position in which the platen roller and the print head come into contact with each other, and a second position in which the platen roller and the print head are separated from each other;

a cover configured to be opened and closed over the holder;

an operation member movable along with an opening and closing of the cover, and that moves the holder to the first position when the cover is closed; and a cam pressing member that slidably contacts the holder to force the holder to the second position when the cover is opened.

12. The tape printer according to claim 11, wherein the holder comprises a lever rotatable about a holder shaft, the lever holding either one of the platen roller and the print head on a first end of the lever and having a cam receiver on a second end of the lever.

13. The tape printer according to claim 12, wherein the cam pressing member slidingly contacts the cam receiver to force the holder to the second position when the cover is opened.

14. The tape printer according to claim 11, wherein the holder comprises a lever rotatable about a holder shaft, the lever holding either one of the platen roller and the print head and having a projection between the either one of the platen roller and the print head and the holder shaft.

15. The tape printer according to claim 14, wherein the cam pressing member comprises an engagement groove that is engageable with the projection to move the holder to the second position when the cover is opened.

* * * * *